US007340882B2

(12) United States Patent
Lapergue et al.

(10) Patent No.: US 7,340,882 B2
(45) Date of Patent: Mar. 11, 2008

(54) TURBOMACHINE WITH MEANS FOR AXIAL RETENTION OF THE ROTOR

(75) Inventors: Guy Lapergue, Rubelles (FR); Regis Servant, Vigneux sur Seine (FR); Gael Bouchy, La Chapelle Iger (FR); Alain Baum, Rampillon (FR)

(73) Assignee: Snecma Moteurs, Paris (FR)

( * ) Notice: Subject to any disclaimer, the term of this patent is extended or adjusted under 35 U.S.C. 154(b) by 361 days.

(21) Appl. No.: 11/149,214

(22) Filed: Jun. 10, 2005

(65) Prior Publication Data

US 2005/0276683 A1 Dec. 15, 2005

(30) Foreign Application Priority Data

Jun. 11, 2004 (FR) ..... 04 06306

(51) Int. Cl.
*F02C 7/06* (2006.01)

(52) U.S. Cl. ..... 60/223; 60/39.091; 415/9

(58) Field of Classification Search ..... 60/39.08, 60/39.091, 223, 792; 415/9; 416/2
See application file for complete search history.

(56) References Cited

U.S. PATENT DOCUMENTS 4,475,869 A 10/1984 Davies
5,791,789 A 8/1998 Van Duyn et al.
5,974,782 A * 11/1999 Gerez ..... 60/223
6,009,701 A * 1/2000 Freeman et al. ..... 60/223
6,098,399 A * 8/2000 Richards et al. ..... 60/223

FOREIGN PATENT DOCUMENTS

EP 1 308 602 A1 5/2003

* cited by examiner

*Primary Examiner*—L. J. Casaregola
(74) *Attorney, Agent, or Firm*—Oblon, Spivak, McClelland, Maier & Neustadt, P.C.

(57) ABSTRACT

The turbomachine of the invention extends longitudinally along an axis, and includes a rotor attached to drive shaft, arranged to rotate around an axis, supported by at least a first bearing, mounted on the fixed structure of the turbomachine by a bearing support element. The turbomachine is characterised by the fact that it includes a stop ring, mounted on the fixed structure of the turbomachine, to cooperate with the support element of the first bearing and, in the event of displacement of the rotor in relation to the fixed structure, to perform a function of axial retention of the rotor in an even manner, with no angle effect between the axis of the turbomachine and the axis of the drive shaft.

11 Claims, 4 Drawing Sheets

TURBOMACHINE WITH MEANS FOR AXIAL RETENTION OF THE ROTOR

BACKGROUND OF THE INVENTION

1. Field of the Invention

The invention concerns the area of turbomachines and in particular of turbojet engines with their fan attached to a drive shaft which is supported by at least a first bearing.

2. Discussion of the Background

Such a turbojet engine includes, from upstream to downstream in the direction of the flow of the gases, a fan, one or more compressor stages, a compression chamber, one or more turbine stages and a gas-exhaust nozzle. The fan includes a rotor fitted with blades on its circumference which, when they are rotated, drive the air into the turbojet engine. The fan rotor is supported by the shaft of the low-pressure rotor of the engine. It is centred on the axis of the turbojet engine by a first bearing which is upstream of a second bearing connected to the fixed structure, in particular the intermediate housing.

In the remainder of the description, to the extent that the fan is attached to the compressor shaft, which is the shaft of the low-pressure rotor in a twin-shaft engine, this shaft is known by the unique term of "compressor shaft".

The first bearing is supported by a support element, forming an envelope around the compressor shaft, oriented to downstream of the first bearing and secured to a fixed structure of the turbojet engine. The second bearing is supported by a support element which is also secured to a fixed structure of the turbojet engine.

It can happen that a blade may become detached from the fan accidentally. This results in a severe imbalance in the compressor shaft, which leads to loads and vibrations on the bearings, transmitted by their support elements to the fixed structures of the turbojet engine, which can be damaged as a result.

In order to prevent a risk of excessive damage to the turbojet engine, it is possible to over-dimension the structure or, as in patent FR 2,752,024, to propose a system for uncoupling of the first bearing. The support element of the first bearing is fixed to the structure of the turbojet engine by screws of the fuse or rupture type, which include a weakened section that causes them to break in the event of excessive forces. Thus, on the appearance of the imbalance in the compressor shaft, the forces exerted on the first bearing are transmitted to the rupture screws which break, uncoupling the support element of the first bearing from the structure of the turbojet engine. According to other methods of implementation, the support of the second bearing is associated with that of the first bearing in order to accompany it in the event of uncoupling, or includes its own uncoupling system, independent of that of the first bearing. After uncoupling, the forces created by the imbalance are no longer transmitted to the fixed structure of the turbojet engine by the support elements of the bearing or bearings.

However, after the uncoupling of one or both bearings, the fan continues to rotate, and the compressor shaft can no longer rotate on its axis and undergoes large displacements capable of damaging the fixed structure of the turbojet engine. In this case, patent FR 2,752,024 proposes the provision, on the fixed structure of the turbojet engine, of a stiffening band surrounding the support element of the first bearing, to which, in this case, is attached that of the second bearing, and performing the function of movement limiter or back-up bearing.

The continued rotation of the fan can nevertheless lead to stresses in the compressor shaft and the turbine shaft, which are attached to each other, and can give rise to breakage of one or both of these. In any case, we are speaking of rupture of the compressor shaft. In this case, the rotation of the fan leads to the latter, as well as the compressor shaft to which it is attached toward the front. The fan is then ejected out of the turbojet engine, and this is what has to be prevented.

The band proposed in patent FR 2,752,024 can however, in the event of rupture of the compressor shaft, perform a function of axial retention of the fan rotor, with the fixing bracket of the support element of the first bearing to the fixed structure of the turbojet engine then coming up against a radial wall of this band. However, because of the flexing to which the compressor shaft can be subjected in this situation, an angle can exist between the wall of the bracket and the wall of the band about to abut, resulting in either a rather ineffective stopping of the shaft with damage to the elements through friction, or even, if the angle is too great, to passage of the bracket, inclined radially in relation to the axis of the turbojet engine, beyond the band, therefore making it impossible to stop the advance of the compressor shaft and of the fan rotor, which are then ejected or trapped across its retention fairing, thus damaging the whole structure of the turbojet engine.

SUMMARY OF THE INVENTION

This present invention aims to overcome these drawbacks.

To this end, the invention concerns a turbomachine, extending longitudinally along an axis, that includes a rotor, attached to a drive shaft, designed to rotate around an axis, supported by at least a first bearing, mounted on the fixed structure of the turbomachine by a bearing support element, characterised by the fact that it includes a stop ring, mounted on the fixed structure of the turbomachine to cooperate with the support element of the first bearing and thus, in the event of displacement of the rotor in relation to the fixed structure, perform a function of axial retention of the rotor, in an even manner, with no angle effect between the axis of the turbomachine and the axis of the drive shaft.

By virtue of the invention, the axial retention of the rotor, for example in the case of rupture of the compressor shaft following the loss of a blade from the fan, if the rotor is a fan rotor, occurs in an even manner regardless of the angle between the axis of the compressor and the axis of the turbomachine at the moment of the retention process. This angle, which can vary because of the imbalance experienced by the shaft, therefore has no effect upon the axial retention of the rotor.

It is preferable that the support element of the first bearing should have a journal that is designed to fit onto the surface of a rim of the stop ring.

Advantageously in this case, the journal is of tapered form.

Again advantageously, in axial section, the surface of the rim of the stop ring is of curved shape, with rotational symmetry around the axis of the turbomachine.

It is preferable in this case that the curved shape should be the arc of a circle.

It is preferable that the stop ring should encircle the downstream part of the support element of the first bearing longitudinally, without contact in the normal method of operation of the turbomachine.

According to one form of implementation, with the drive shaft supported by a second bearing, and the second bearing mounted on the fixed structure of the turbomachine by a bearing support element, the support element of the first bearing is fixed to the support element of the second bearing by means of rupture screws allowing its uncoupling from the support element of the second bearing.

According to another form of implementation, with the drive shaft being supported by a second bearing, and with the second bearing being mounted on the fixed structure of the turbomachine by a bearing support element secured by screws, the stop ring includes longitudinal apertures to allow the passage of the said screws, used for securing the stop ring to the fixed structure of the turbomachine.

According to one method of operation, with the support element of the first bearing being mounted on the fixed structure of the turbomachine by means of a device used to uncouple it in relation to the fixed structure of the turbomachine, the stop ring is arranged so as not to interfere with the uncoupling action.

According to another method of operation, with the support element of the first bearing being mounted on the fixed structure of the turbomachine by means of a device used to uncouple it in relation to the fixed structure of the turbomachine, the stop ring is arranged to limit the displacements of the compressor shaft during the uncoupling action.

According to one particular method of implementation, the second bearing is mounted on the fixed structure of the turbomachine by means of a device used to uncouple it in relation to the fixed structure of the turbomachine.

Finally, it is preferable that with the support element of the first bearing being mounted on the fixed structure of the turbomachine by means of a device used to uncouple it in relation to the fixed structure of the turbomachine, the stop ring should, in particular, perform the axial retention of the rotor in the event of rupture of the drive shaft after uncoupling of the first bearing.

The invention applies particularly to a twin-shaft turbojet engine, whose second bearing is one that supports the low-pressure rotor, but the applicant does not intend that the extent of his rights should be limited to this application.

BRIEF DESCRIPTION OF THE DRAWINGS

The invention will be better understood by virtue of the following description of the preferred form of implementation of the turbojet engine of the invention, with reference to the appended drawings, in which.

DETAILED DESCRIPTION OF THE PREFERRED EMBODIMENTS

Figure 1:
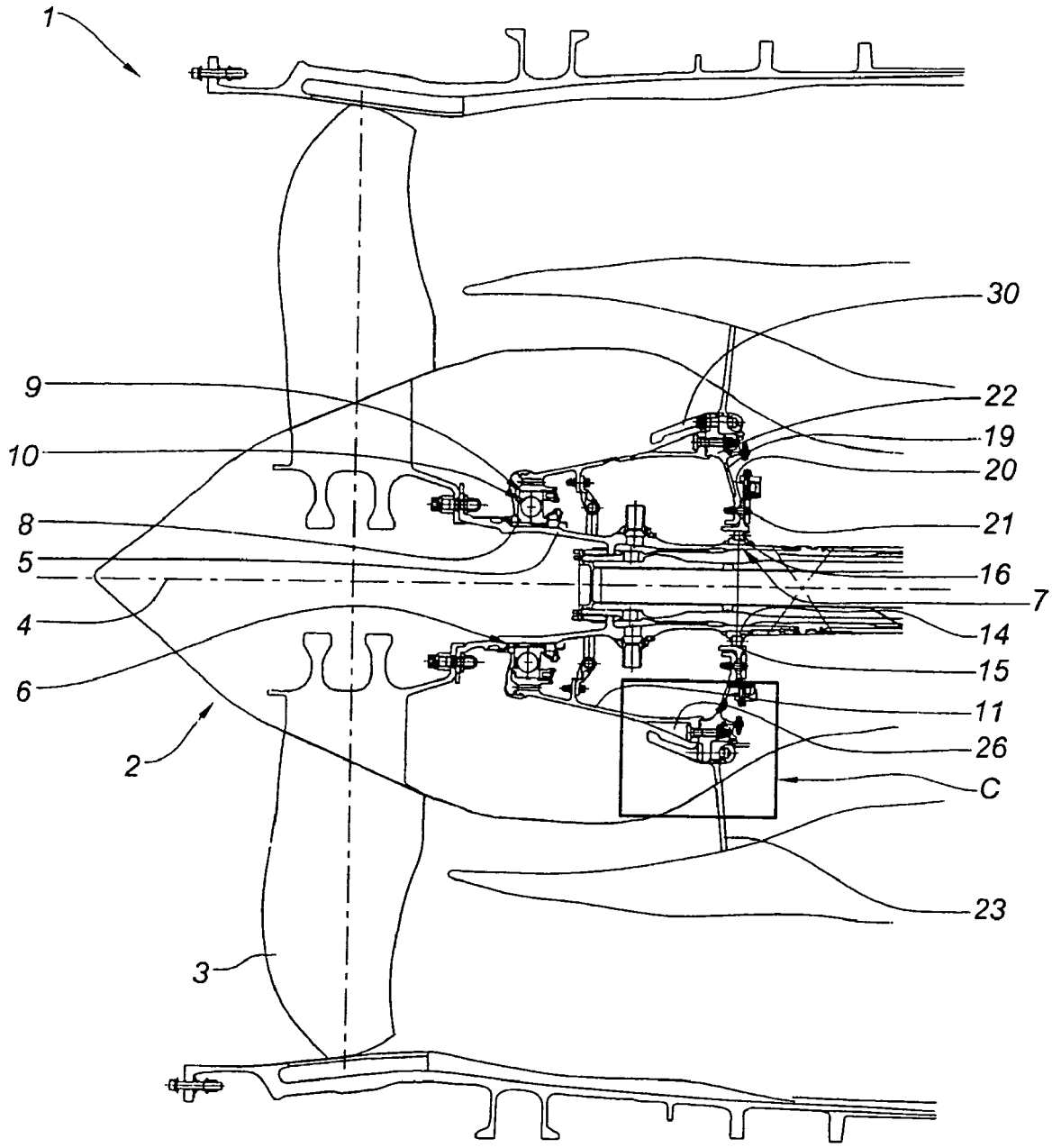
FIG. 1 represents a view in axial section and in profile of the preferred form of implementation of the invention.

With reference to FIG. 1, the turbojet engine 1 of the invention includes a fan 2, the rotor of which includes blades 3 extending radially around the axis 4 of the turbojet engine. The shaft of the fan 2 is fixed, downstream of the blades 3, to the compressor shaft 5. Here this is the low-pressure compressor shaft. In what follows, we will refer to the whole shaft of the fan 2 and of the compressor shaft 5 as the compressor shaft 5 or the drive shaft 5. The compressor shaft 5 is supported by a first bearing 6 and a second bearing 7 located downstream of the first bearing 6.

The first bearing 6 includes an internal ring 8 and an external ring 9, between which are mounted on ball-bearings 10 or any bearing devices. The internal ring 8 is attached to the compressor shaft 5 and the external ring is attached to a bearing support element 11, henceforth called the support of the first bearing 11. The ball-bearings 10 allow the rotation of the internal ring 8, and therefore of the compressor shaft 5, in relation to the external ring 9, and therefore to the support of the first bearing 11.

The support of the first bearing 11 extends from the first bearing 6 toward the dowstream direction. It is of slightly tapered shape, with its diameter increasing in the dowstream direction.

The second bearing 7 includes an internal ring 14 and an external ring 15, between which are mounted roller bearings 16 or any bearing devices. The internal ring 14 is attached to the compressor shaft 5, and the external ring 15 is attached to the fixed structure of the turbojet engine 1. The roller bearings 16 are mounted in parallel with the axis 4 of the turbojet engine 1, in a groove extending to the circumference of the internal ring 14, and are held apart from each other by a cage, this being very familiar to the one skilled in the art. They allow the rotation of the internal ring 14 in relation to the external ring 15 and therefore, by their means, of the compressor shaft 5 in relation to the fixed structure of the turbojet engine 1.

The second bearing 7 is supported by a bearing support element 19, known in what follows as the support of the second bearing 19, generally taking the form of a disc extending transversally to the axis 4 of the turbojet engine 1. The external ring 15 of the second bearing 7 includes, on its external surface, a radial bracket 20, fixed to the support of the second bearing 19 by means of screws 21.

Figure 2:
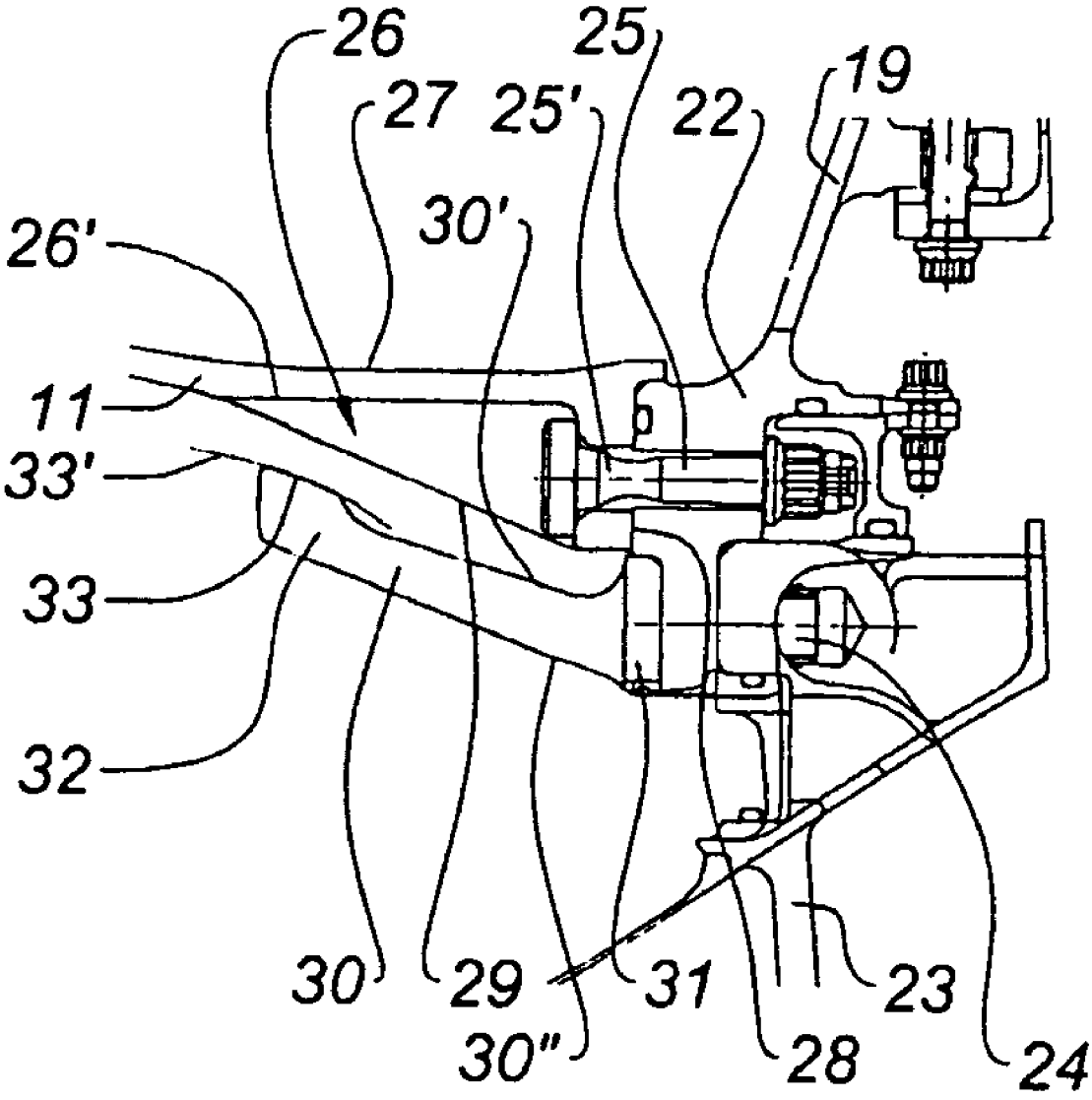
FIG. 2 represents an enlarged view of the zone of FIG. 1 contained in frame C.

Referring to FIG. 2, the support of the second bearing 19 is secured, by means of a radial bracket 22, to the fixed structure of the turbojet engine 1, in this case to a housing 23 known as the intermediate housing 23, by screws 24.

At its downstream extremity, the support of the first bearing 11 has a stop portion 26, here of thickness greater than its upstream part. In axial section, this stop portion 26 has a section in the form of a triangle-rectangle. The internal wall 27 of this stop portion 26 is of cylindrical shape, and its downstream wall 28 extends transversally to the axis 4 of the turbojet engine, with the internal 27 and downstream 28 walls being connected by a wall 29 with a surface of generally tapered form, the diameter of which increases in the dowstream direction, and which corresponds to the hypotenuse of the triangle-rectangle presented by the stop portion 26 in axial section. In its downstream part, the support of the first bearing 11 therefore has a tapered journal 29 constituted by the tapered wall 29.

The stop portion 26 includes longitudinal apertures 26' used for passage of the rupture screws 25 for securing the support of the first bearing 11 to the bracket 22 of the support of the second bearing 19. These rupture screws 25 are located radially between the axis 4 of the turbojet engine 1 and the screws 24 for securing the support of the second bearing 19 to the intermediate housing 23. These rupture screws 25 include a portion of weaker section 25', presenting a resistance to the traction that leads to their rupture in the event of excessive forces, in particular on the appearance of an imbalance in the compressor shaft 5, following the loss of a blade 3 for example.

The intermediate housing 23 supports a stop ring 30, which extends around the stop portion 26 of the support of the first bearing 11, encircling it longitudinally, but with no contact between them in normal operation of the turbojet engine 1. This stop ring 30 is of tapered form, its diameter increasing toward the rear, and with its internal 30' and external 30" walls being virtually parallel over most of its length in this case. At its downstream extremity, it includes a radial bracket 31 by which it is secured to the intermediate housing 23, here by the screws 24 for fixing the support of the second bearing 19 to the intermediate housing 23.

At its upstream extremity, the stop ring 30 includes a rim 32 which projects radially in relation to the interior. The inside surface 33 of the rim 32 is of curved convex shape in axial section, following a curve as represented in FIG. 2 by curve portion 33'.

The stop ring 30 is arranged so that the surface of the tapered journal 29 of the support of the first bearing 11 is able to abut against the inside surface 33 of its rim 32, if the support of the first bearing 11 happens to be driven axially toward the front. The function of the stop ring 30 is to axially block the compressor shaft 5 in the event of rupture, by means of the support of the first bearing 11, in order that the fan 2 which is attached to it should not be driven toward the front in this case, as will be explained later.

The operation of the turbojet engine 1 of the invention during the loss of a blade 3 from the fan 2 will now be explained in greater detail.

Figure 3:
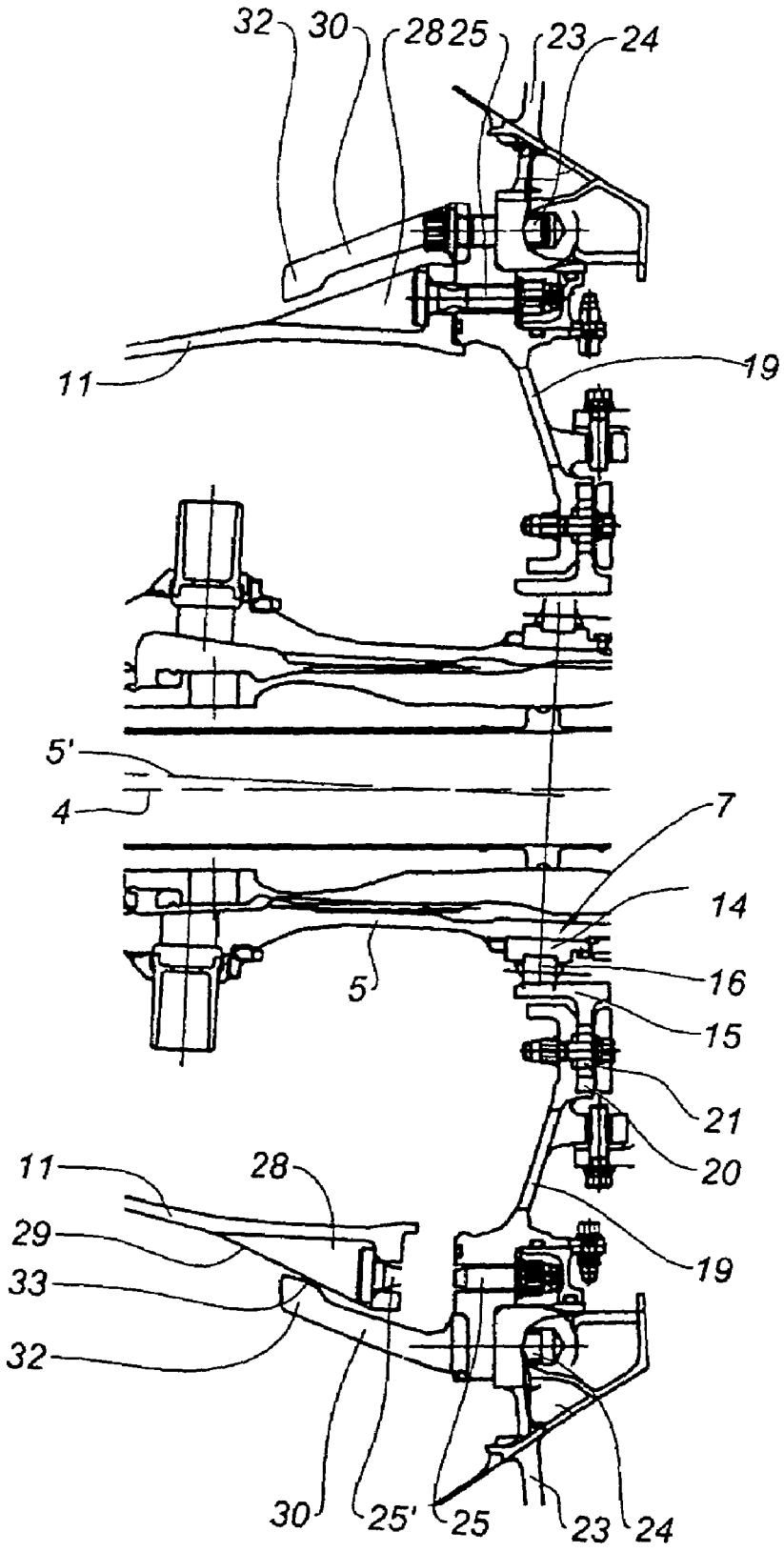
FIG. 3 represents a view in axial section and in profile of the zone of the second bearing of the turbojet engine in the preferred form of implementation of the invention, during an uncoupling action.

The loss of a blade 3 during operation of the turbojet engine 1, therefore during rotation of the fan 2, creates an imbalance on the compressor shaft 5. Referring to FIG. 3, the generated forces cause the breakage of the rupture screws 25 securing the support of the first bearing 11 to the support of the second bearing 19, at the point of their weakened section 25'. The rupture screws 25 do not all break at the same time, but in general do so progressively. In FIG. 3, a rupture screw 25 is shown broken, at the lower end of the figure, while the rupture screw 25 at the upper end is still intact. In this situation, the imbalance has brought about a flexing of the compressor shaft 5, the axis 5' of which is inclined in relation to the axis 4 of the turbojet engine 1. This flexing of the compressor shaft 5 is allowed by a slippage of the rollers of the second bearing 7 on their external ring 15, but probably with damage to this bearing 7 as a consequence.

The support of the first bearing 11, attached to the compressor shaft 5, is likewise inclined in relation to the axis 4 of the turbojet engine 1. The surface of the tapered journal 29 of the first bearing 11 can then abut against the surface of the wall 33 of the rim 32 of the stop ring 30, in the regions where the rupture screws 25 have broken. Because of the duly optimised shape of the surface 33 of the rim 32, the angle has no effect on this contact, which occurs in an even manner regardless of the angle concerned. Thus, during the uncoupling action of the support of the first bearing 11 from the fixed structure of the turbojet engine 1, the stop ring 30, in the form of implementation described here, to some extent limits the flexing of the compressor shaft 5 in an even manner. This flexing can also be limited, as is generally the case, because of the take-up of the play between the extremities of the blades 3 of the fan 2 and their retention housing.

According to another form of implementation, the longitudinal distance between the tapered journal 29 of the support of the first bearing 11 and the rim 32 of the stop ring 30 can be dimensioned in such a way that the surfaces of the tapered wall 29 and of the rim 32 never come into contact during the uncoupling action, in order not to interfere with the latter. It is this form of implementation which will be preferred, in which the stop ring 30 performs only the function of axial retention, with no limiting function of radial movements.

Whatever the form of implementation, once all of the rupture screws 25 have broken, the support of the first bearing 11 is uncoupled from the support of the second bearing 19, and thus from the intermediate housing 23, meaning that it is uncoupled from the fixed structure of the turbojet engine 1. The forces are then no longer transmitted to the fixed structure of the turbojet engine by the support of the first bearing 11 and the compressor shaft 5 can rotate freely on its axis 5', since the tapered journal 29 of the support of the first bearing 11 and the rim 32 of the stop ring 30 are not in contact.

However continued the rotation of the fan 2 can lead to stresses in the compressor shaft 5 and the turbine shaft, which are attached, and cause one or both of these to break. As we have seen previously, we are then speaking of rupture of the compressor shaft 5. In this case, the rotation of the fan 2 drives the latter, and the compressor shaft 5 which is attached to it, toward the front.

Figure 4:
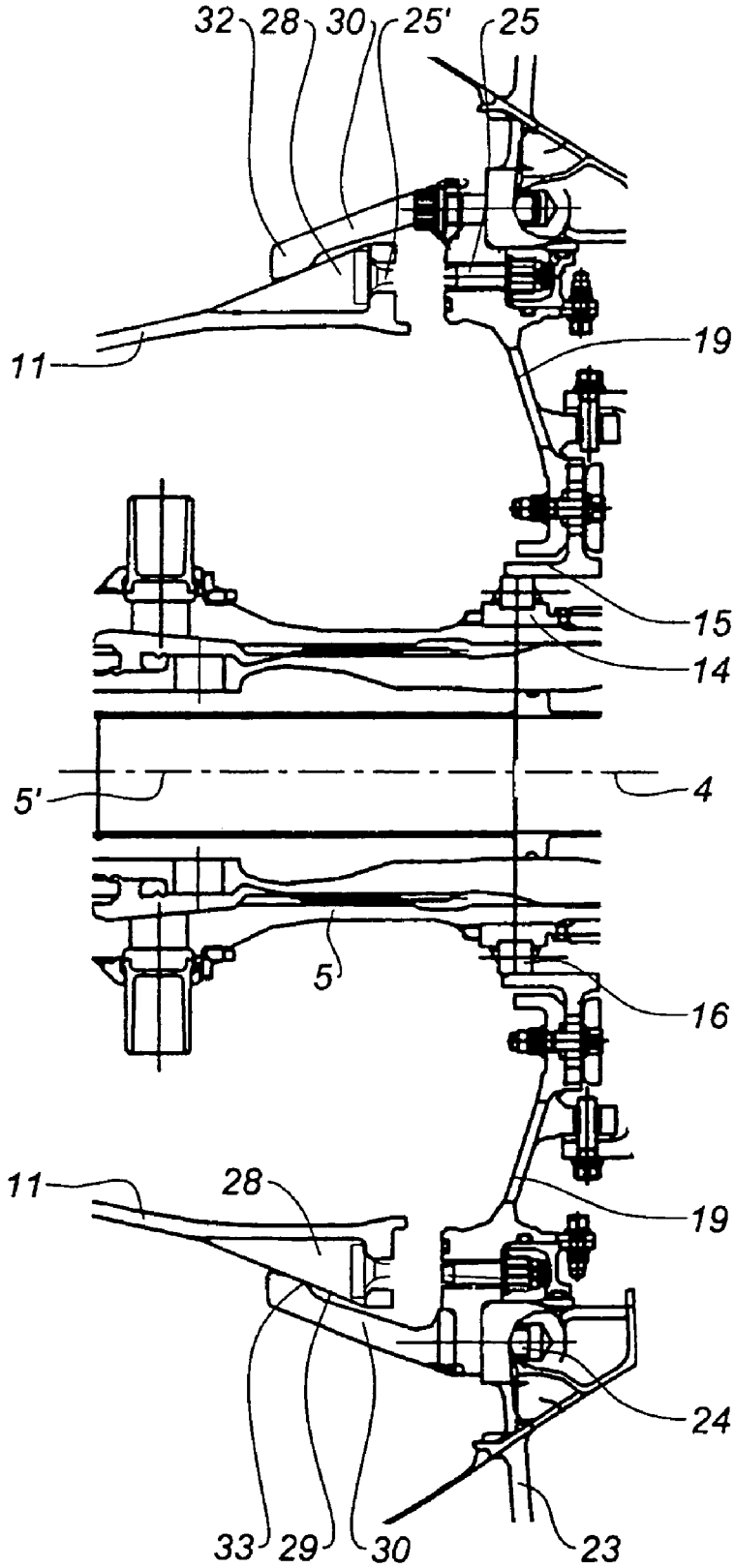
FIG. 4 represents a view in axial section and in profile of the zone of the second bearing of the turbojet engine in the preferred form of implementation of the invention, after rupturing of the compressor shaft.

The support of the first bearing 11 is then also driven toward the front, as are the rollers 16 of the second bearing 7, which slip on their external ring 15. Referring to FIG. 4, this movement toward the front is halted by virtue of the stop ring 30 attached to the fixed structure of the turbojet engine 1. In fact during the forward movement of the support of the first bearing 11, the tapered journal 29 of the support of the first bearing 11 abuts against the wall 33 of the rim 32 of the stop ring 30, which thus ensures the axial stoppage of the support of the first bearing 11 and therefore of the fan 2, which is not ejected out of the turbojet engine. The rotation of the fan 2 can continue for a short time before stopping through friction.

The curve 33' defining the inside surface 33 of the rim 32 is optimised in such a way that the abutting of the journal 29 of the first bearing 11 onto this surface 33, and therefore the stopping of the fan 2, occur in an even manner, independently of the angle that may exist between the axis 5' of the compressor shaft 5 and the axis 4 of the turbojet engine 1. This curved shape of the inside surface 33 of the rim 32 is a meridian curve in an axial plane, with rotational symmetry around the axis 4 of the turbojet engine. Here, in axial section view, the curve 33' is of circular form. This curve 33' could be of more complex form in order, for example, to comply with the different phases of the uncoupling process—with or without contact depending on the stages.

As a consequence, continued rotation of the fan 2 after uncoupling of the support of the first bearing 11 does not necessarily occur around the axis 4 of the turbojet engine 1, since in fact the compressor shaft 5 is no longer centred by the first bearing 6. At the moment of rupture of the compressor shaft 5, and of its forward movement, the angle of its axis 5' with the axis 4 of the turbojet engine 1 is random. This randomness does not disrupt the stopping of the fan 2 by the retention ring 30, because of the optimised shape of the wall 33 of its rim 32. With continued rotation of the fan 2 combined with its forward motion, the rim also enables the fan 2 and the compressor shaft 5 to be returned to the axis 4 of the turbojet engine 1, as is the case in FIG. 4.

The invention has been described in relation to the support of the first bearing secured to the fixed structure of the turbojet engine by means of the support of the second bearing, while the stop ring is secured to the fixed structure of the turbojet engine by the screws for fixing of the support of the second bearing to this fixed structure. It goes without saying that the first bearing support, the second bearing support, and the stop ring could be secured to the fixed structure of the turbojet engine independently of each other, and that they could perform the same functions as those described.

Moreover, in the case where the stop ring is secured to the fixed structure of the turbojet engine in an independent manner, the support of the second bearing could be secured to this structure by rupture screws. Thus, uncoupling of both bearings would possible, with the axial stopping by the stop ring occurring only in the event of rupture of the compressor shaft.

The downstream 29 journal of the first bearing 11 has been described here as being of tapered form. It goes without saying that it could also have a curved shape in the axial section view, this shape being optimised in correlation with the curve 33' presented by the surface 33 of the rim 33 of the stop ring 30, so that stoppage of the fan should occur in an even manner, with no angle effect.

It can be seen that the stop ring 30 could also perform a function of back-up bearing, acting as a bearing for the compressor shaft 5 in the event of rupture of the latter after uncoupling of the first bearing 6.

The invention has been described in relation to a turbojet engine, in particular a twin-shaft turbojet engine whose second bearing is one that supports the low-pressure rotor. The invention also applies to other types of turbomachines, such as a turbo-prop, an industrial turbocharger or an industrial turbine, when the rotor is not then used as a fan rotor but just as a rotor.

The invention claimed is:

1. A turbomachine, extending longitudinally along an axis, said turbomachnie comprising:

a rotor attached to a drive shaft, arranged to rotate around an axis, supported by at least a first bearing, mounted on the fixed structure of the turbomachine by a bearing support element; and a stop ring, mounted on the fixed structure of the turbomachine to cooperate with the support element of the first bearing and, in the event of displacement of the rotor in relation to the fixed structure, to perform a function of axial retention of the rotor, in an even manner, with no angle effect between the axis of the turbomachine and the axis of the drive shaft, wherein the support element of the first bearing has a journal which is designed to cooperate with the surface of a rim of the stop ring, and wherein the journal is of tapered form.

2. A turbomachine according to claim 1, wherein the surface of the rim of the stop ring has a curved shape in axial section, with rotational symmetry around the axis of the turbomachine.

3. A turbomachine according to claim 2, wherein the curved shape is the arc of a circle.

4. A turbomachine according to claim 1, wherein the stop ring longitudinally encircles the downstream part of the support element of the first bearing, without contact in the normal mode of operation of the turbomachine.

5. A turbomachine extending longitudinally along an axis, said turbomachnie comprising:

a rotor attached to a drive shaft, arranged to rotate around an axis, supported by at least a first bearing, mounted on the fixed structure of the turbomachine by a bearing support element; and a stop ring, mounted on the fixed structure of the turbomachine to cooperate with the support element of the first bearing and, in the event of displacement of the rotor in relation to the fixed structure, to perform a function of axial retention of the rotor, in an even manner, with no angle effect between the axis of the turbomachine and the axis of the drive shaft, wherein, with the drive shaft supported by a second bearing, and with the second bearing mounted on the fixed structure of the turbomachine by a bearing support element, the support element of the first bearing is fixed to the support element of the second bearing by rupture screws allowing the support element of the first bearing to be uncoupled from the support element of the second bearing.

6. A turbomachine according to claim 1, wherein, with the support element of the first bearing mounted on the fixed structure of the turbomachine by a device used to uncouple the support element of the first bearing in relation to the fixed structure of the turbomachine, the stop ring is arranged so as not to interfere with the uncoupling action.

7. A turbomachine according to claim 1, wherein, with the support element of the first bearing mounted on the fixed structure of the turbomachine by a device used to uncouple the support element of the first bearing in relation to the fixed structure of the turbomachine, the stop ring is arranged to limit the displacements of the compressor shaft during the uncoupling action.

8. A turbomachine extending longitudinally along an axis, said turbomachnie comprising:

a rotor attached to a drive shaft, arranged to rotate around an axis, supported by at least a first bearing, mounted on the fixed structure of the turbomachine by a bearing support element; and a stop ring, mounted on the fixed structure of the turbomachine to cooperate with the support element of the first bearing and, in the event of displacement of the rotor in relation to the fixed structure, to perform a function of axial retention of the rotor, in an even manner, with no angle effect between the axis of the turbomachine and the axis of the drive shaft, wherein, with the drive shaft supported by a second bearing, the second bearing is mounted on the fixed structure of the turbomachine by a device used to uncouple the second bearing in relation to the fixed structure of the turbomachine.

9. A turbomachine extending longitudinally along an axis, said turbomachnie comprising:

a rotor attached to a drive shaft, arranged to rotate around an axis, supported by at least a first bearing, mounted on the fixed structure of the turbomachine by a bearing support element; and a stop ring, mounted on the fixed structure of the turbomachine to cooperate with the support element of the first bearing and, in the event of displacement of the rotor in relation to the fixed structure, to perform a function of axial retention of the rotor, in an even manner, with no angle effect between the axis of the turbomachine and the axis of the drive shaft, wherein, with the drive shaft supported by a second bearing, and with the second bearing mounted on the fixed structure of the turbomachine by a bearing support element secured by screws, the stop ring includes longitudinal apertures used for the passage of the said screws so as to secure the stop ring to the fixed structure of the turbomachine.

10. A turbomachine according to claim 1, wherein with the support element of the first bearing mounted on the fixed structure of the turbomachine by a device used to uncouple the support element of the first bearing in relation to the fixed structure of the turbomachine, the stop ring in particular performs the axial retention of the rotor in the event of rupture of the drive shaft after uncoupling of the first bearing.

11. A turbomachine, extending longitudinally along an axis, said turbomachnie comprising:

a rotor attached to a drive shaft, arranged to rotate around an axis, supported by at least a first bearing, mounted on the fixed structure of the turbomachine by a bearing support element; and a stop ring, mounted on the fixed structure of the turbomachine to cooperate with the support element of the first bearing and, in the event of displacement of the rotor in relation to the fixed structure, to perform a function of axial retention of the rotor, in an even manner, with no angle effect between the axis of the turbomachine and the axis of the drive shaft, wherein the support element of the first bearing has a journal which is designed to cooperate with the surface of a rim of the stop ring, and wherein the journal has a curved shape in an axial section view.

* * * * *

UNITED STATES PATENT AND TRADEMARK OFFICE

CERTIFICATE OF CORRECTION

PATENT NO. : 7,340,882 B2
APPLICATION NO. : 11/149214
DATED : March 11, 2008
INVENTOR(S) : Guy Lapergue et al.

It is certified that error appears in the above-identified patent and that said Letters Patent is hereby corrected as shown below:

In column 1, line 18, change “centred” to --centered--.

In column 7, line 13, before “possible” insert --be--;
line 36, change “turbomachnie” to --turbomachine--;
line 63, change “turbomachnie” to --turbomachine--.

In column 8, line 30, change “turbomachnie” to --turbomachine--;
line 48, change “turbomachnie” to --turbomachine--.

In column 9, line 10, change “turbomachnie” to --turbomachine--.

Signed and Sealed this

Fourth Day of November, 2008

JON W. DUDAS
*Director of the United States Patent and Trademark Office*